United States Patent [19]

Reim

[11] 4,201,015

[45] May 6, 1980

[54] FILM IMAGE REMOVAL PROCESS AND APPARATUS

[76] Inventor: William K. Reim, 20 Oak Ave., Penndel, Pa. 19047

[21] Appl. No.: 926,464

[22] Filed: Jul. 20, 1978

[51] Int. Cl.[2] ..... B24B 7/02

[52] U.S. Cl. ..... 51/74 R; 15/77; 15/102; 51/273; 51/277; 51/281 R

[58] Field of Search ..... 15/77, 102; 51/22, 74 R, 51/76 R, 91 R, 273, 281 R, 217 R, 277; 248/451; 40/152, 156

[56] References Cited

U.S. PATENT DOCUMENTS

| | | | |
|---|---|---|---|
| 864,254 | 8/1907 | Perkins | 248/451 X |
| 883,433 | 3/1908 | Utz | 248/451 |
| 985,294 | 2/1911 | Senecal | 248/451 |
| 2,070,944 | 2/1937 | Hillix | 51/91 R X |
| 2,384,414 | 9/1945 | Antrim | 51/273 X |
| 2,639,254 | 5/1953 | Smith | 40/152 X |
| 2,814,171 | 11/1957 | Bogart | 51/273 |
| 3,220,131 | 11/1965 | Dieck | 40/152 |
| 3,271,909 | 9/1966 | Rutt et al. | 51/76 R X |
| 3,435,566 | 4/1969 | Enserink | 51/76 R X |
| 3,611,643 | 10/1971 | Crane et al. | 51/76 R |
| 3,840,000 | 10/1974 | Bible | 51/217 R X |
| 3,862,517 | 1/1975 | Porter | 51/91 R |

*Primary Examiner*—Gary L. Smith
*Assistant Examiner*—Robert P. Olszewski
*Attorney, Agent, or Firm*—Caesar, Rivise, Bernstein & Cohen, Ltd.

[57] ABSTRACT

Apparatus and a method for removing images which are disposed on a surface of a film section, such as a microfiche card. The apparatus comprises a housing in which a motor-driven, rotary abrasive wheel is disposed. A carrier tray is provided to support the film section to be treated and is arranged to carry the film section into the housing under the wheel so that the rotating wheel scrapes the surface of the film, thereby removing the image. A fan and filter means are provided in the housing to trap the particles produced during the image removal operation, to thereby preclude the egress of such particles to the ambient atmosphere.

8 Claims, 6 Drawing Figures

FILM IMAGE REMOVAL PROCESS AND APPARATUS

This invention relates generally to apparatus and a method for effecting document destruction and more particularly to apparatus and a method for removing images from microfiche cards and other microfilm materials having surface-borne images.

In the interest of security it is frequently necessary to destroy documents. Where the document to be destroyed comprises microfilm in which the information is carried in an emulsion or dye layer on the film's surface, e.g., microfiche cards, prior art destruction techniques have exhibited various drawbacks.

As is known, a microfiche card includes a base of polyester film which is covered with a diazo dye. The dye is secured to the surface to create the image by an ammonia process. Heretofore destruction of the information bearing images on such cards has been accomplished in one of two ways. One technique entails the destruction of the card itself through the use of a shredding process. This technique is a decidedly disadvantageous one since the polyester base of the card is relatively tough and quickly wears down conventional shredding apparatus. The preferred information destruction technique for microfiche cards is a chemical one which entails the stripping of the image-creating diazo dye using acetone or methylene chloride solvents. While chemical stripping is effective for removing the diazo dye image it is of limited utility since the solvents used are not only toxic but also highly volatile and rapidly spread to the ambient atmosphere unless the system is closed or includes ventilating means. This drawback renders the chemical treatment technique virtually useless for a number of closed atmosphere environments, e.g., on submarines, etc.

Accordingly, it is a general object of the instant invention to overcome the disadvantages of the prior art.

It is a further object of the instant invention to provide apparatus for mechanically removing the image from the surface of a film section and without necessitating the destruction of the film base.

It is still a further object of the instant invention to provide apparatus for removing the image from the surface of a film section and for preventing all particles and debris created during the removal operation from gaining egress to the ambient atmosphere.

It is still a further object of the instant invention to provide apparatus which is simple in construction and which quickly and reliably effects the removal of surface-borne images from film.

It is yet a further object of the instant invention to provide a method for mechanically removing a surface-borne image from a film section while precluding debris produced during operation from gaining egress to the ambient atmosphere.

These and other objects of the instant invention are achieved by providing apparatus for removing the image disposed on a surface of a section of film. The apparatus comprises scaling means and carrier means supporting the film section, with its image carrying surface exposed. The carrier means is movable relative to the scaling means to carry the film section into contact with the scaling means, whereupon the scaling means scrapes along the exposed surface of the film section to remove the image therefrom. The scaling means is disposed within a housing which is arranged to trap particles produced as the image is scraped from the card or film base.

Other objects and many of the attendant advantages of the instant invention will be readily appreciated as the same becomes better understood by reference to the following detailed description when considered in connection with the accompanying drawing wherein.

Figure 1:
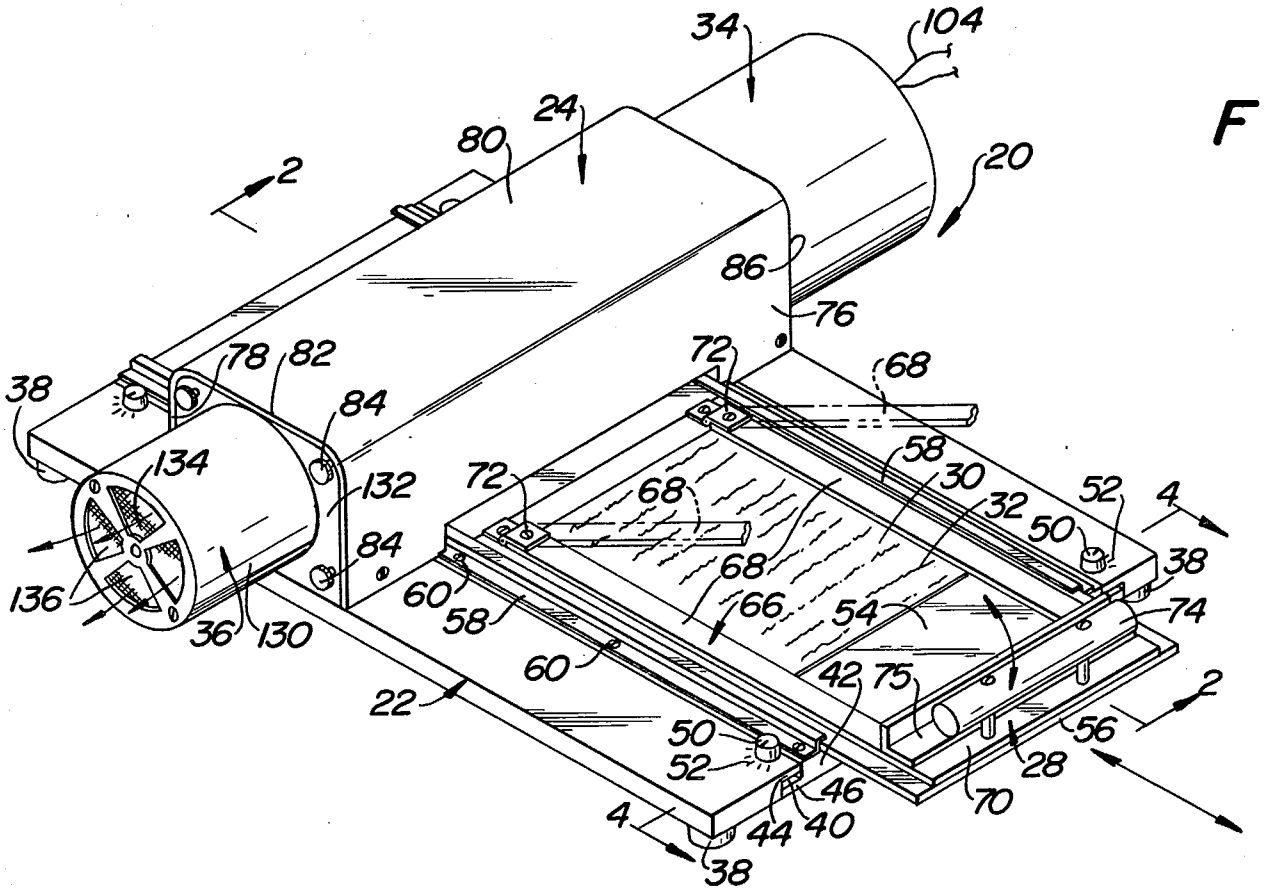
FIG. 1 is a perspective view of the apparatus in accordance with the instant invention.

Referring now to the various figures of the drawing wherein like reference characters refer to like parts, there is shown at 20 apparatus for removing surface-disposed images from film sections. It should be pointed out at this juncture, that while the apparatus 20 has particular utility for removing diazo dye images from the surface of microfiche cards, it can be used to remove any image which is carried on a film surface, e.g., vesicular microfilm, silver halide emulsion microfilm, etc.

As can be seen in FIG. 1, the apparatus 20 basically comprises a base 22, an enclosed housing 24 mounted on the base, scaling means 26 (FIG. 2) disposed within the housing and carrier means 28 mounted on the base. The carrier means is arranged to carry a microfiche card 30, or any other film section having an image 32 formed in an emulsion or dye layer on the upper surface thereof, into the housing and into contact with the scaling means, whereupon the image 32 is scraped from the card. To that end, as will be described in detail later, the scaling means preferably comprises a rotary abrasive wheel which is rotated at a high rate of speed, e.g., 3,000 r.p.m., while the card is carried past it to scrape the image off the entire surface of the microfiche card. The apparatus includes an electrical motor 34 mounted on the housing for rotating the scaling wheel. A fan-filter assembly 36 is mounted on the housing and is operative to trap the diazo dye particles or other debris produced during the scraping operation in a filter element to thereby preclude such particles from gaining egress to the ambient atmosphere.

Figure 4:
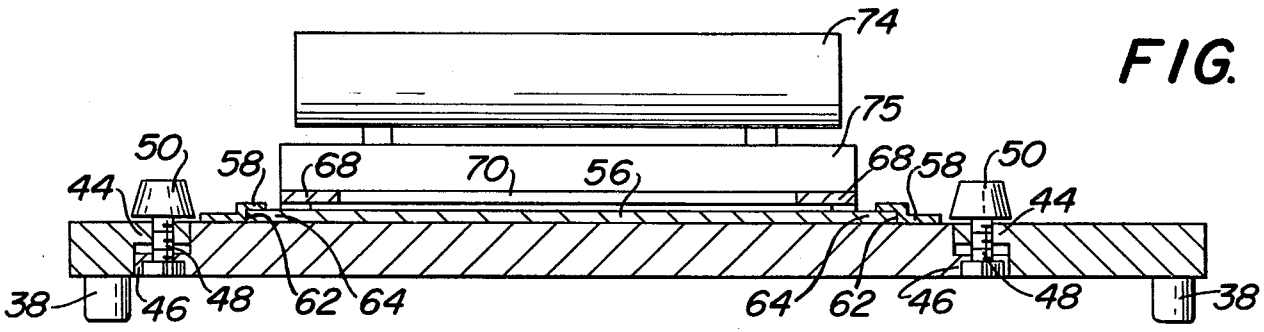
FIG. 4 is a sectional view taken along line 4—4 of FIG. 1.
Figure 6:
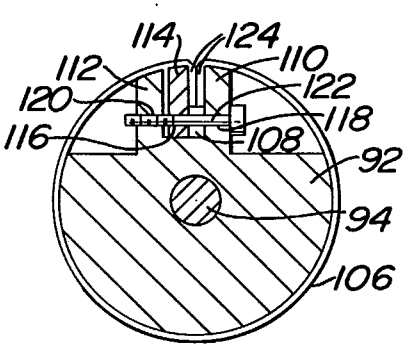
FIG. 6 is a sectional view taken along line 6—6 of FIG. 3.

The base 22 of the apparatus 20 is a planar member having a plurality of feet 38 disposed on the underside thereof for supporting the apparatus on a work surface, e.g., a table, etc. The base includes a longitudinally extending central channel 40 in which is disposed a carrier support bed 42. Each side of the channel includes an upper flange 44. The bed 42, as can be seen in FIGS. 1 and 4, is an elongated planar member whose side edges are in the form of lower flanges 46. When the bed 42 is disposed within the channel 40 its flanges 46 underlie flanges 44 of the base contiguous with the channel. The bed 42 is supported in the channel, via a plurality of adjusting screws 48 (FIG. 4). Each screw extends through a threaded hole in the flange 46 of the bed 42 and a threaded hole in the overlying flange 44 of the base. The bed can be raised or lowered with respect to the base 22 by rotating the screws 48. In order to facilitate precise adjustment of the bed height, for reasons to be described later, each adjustment screw 48 includes a pointer knob 50 at its top. Graduated indicia 52 are provided in the top surface of the base contiguous with each adjustment knob so that each knob can be rotated to the same position to raise or lower the bed to a precise predetermined position, if so desired.

Figure 2:
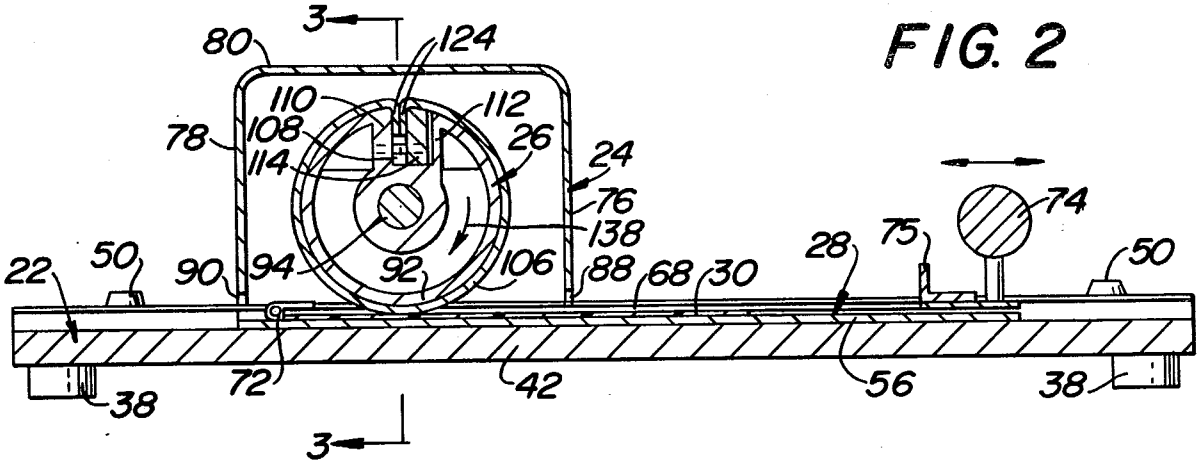
FIG. 2 is a sectional view taken along line 2—2 of FIG. 1.

The bed 42 supports the carrier means 28 on its top surface 54. As can be seen in FIGS. 1, 2 and 4 the carrier means 28 comprises an elongated planar tray 56. The tray is arranged to be reciprocated along the surface 54 of the bed 42. To that end an opposed pair of guide rails 58 are mounted longitudinally along the bed by screws 60. Each rail 58 forms a channel 62 between it and the top surface of the bed and into which an associated edge 64 of the tray 56 is disposed. Accordingly, the rails hold the carrier tray on the surface of the bed but enable it to be slid towards and away from the housing.

As noted heretofore, the carrier tray serves as the means for holding the carrying the card 30 into the housing for the scaling operation. In this connection the card is held in place on the top surface of the tray by a hold-down frame 66 (FIG. 1). The frame 66 is generally U-shaped member having a pair of side legs 68 and a cross piece 70. The end of each leg 68 is secured to the top surface of the tray 56 by a respective hinge 72. A handle 74 is mounted on the top surface of the bridging section 70 of the hold-down frame 66.

The frame 66 is arranged to pivot upward to enable a microfiche card 30 to be disposed on the top surface of the tray 56. Once the card is properly disposed in place the frame is then pivoted down such that its legs 68 slightly overlap the side edges of the card 30. This action effectively holds the card in place on the tray while leaving its image bearing surface totally exposed. Once the card is secured in place on the tray the handle 74 of the tray is pushed inward, that is, toward the housing, to slide the tray down the rails 58 and thereby carry the card into the housing for abrading by the scaling means. A flanged stop 75 is mounted on the top surface of cross piece 70 of the hold-down frame 66. The function of the stop will be described later.

As can be seen in FIGS. 1 and 2 the housing 24 includes a front wall 76, a rear wall 78 and a top wall 80. The fan-filter assembly 36 is mounted at one end 82 of the housing, via plural screw knobs 84, as will be described in detail later, while the electric motor 34 is mounted at the other end 86 of the housing. The bottom edge of the front wall 76 of the housing includes a passageway 88 just wide enough and high enough to enable the carrier tray 56 to pass therethrough. A similar passageway 90 (FIG. 2) is provided in the bottom edge of the back wall 78 of the housing. Except for the passageways 88 and 90 the housing is completely enclosed. This feature is of considerable importance to ensure that particles of the diazo dye which result from the scraping operation do not become airborne and gain egress into the ambient atmosphere.

Figure 3:
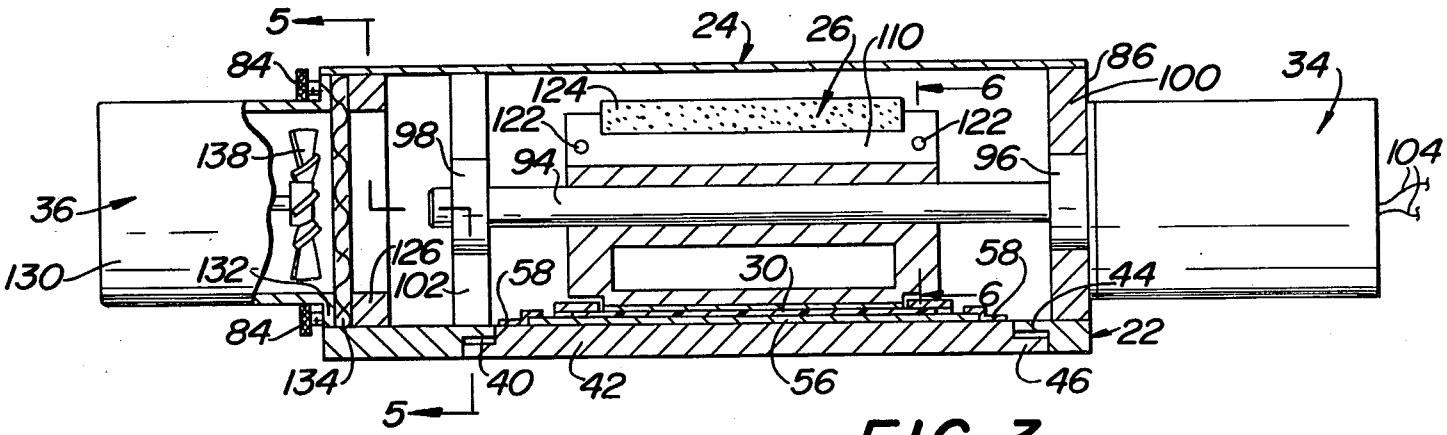
FIG. 3 is a sectional view taken along line 3—3 of FIG. 2.

The scaling means 26 is shown clearly in FIGS. 2 and 3 and basically comprises a hollow, elongated, cylindrical wheel 92 having a central passageway through which a shaft 94 extends. The wheel is fixedly secured to the shaft (by means not shown). The shaft is an elongated member which extends through a pair of opposed support bearings 96 and 98 disposed on opposite sides of the wheel. Bearing 96 is mounted within a wall member 100. The wall member 100 forms the end wall 86 of the housing. The motor 34 is mounted on the wall 100. The other bearing 98 is mounted on a beam 102 (FIG. 5) located within the housing adjacent the end 82. The shaft 94 is connected to the motor by gear means (not shown) and is arranged to rotate about its longitudinal axis within bearings 96 and 98 when the motor 34 is energized via electrical conductors 104. Since the scaling wheel 92 is mounted on the shaft 94, rotation of the shaft results in the concomitant rotation of the scaling wheel.

The scaling wheel includes an abrasive peripheral surface. In accordance with the preferred embodiment of this invention the abrasive surface is in the form of a strip 106 of abrasive material, e.g., medium grit, emergy cloth, which is releasably secured to the periphery of the wheel 92. To that end the cylindrical wheel 92 includes a longitudinally extending channel 108 formed between a pair of sidewalls 110 and 112. An elongated clamping bar 114 is disposed within the elongated channel 108. The clamping bar includes a pair of threaded holes 116 at opposite ends thereof. The sidewalls 110 and 112 include aligned openings 118 and 120, respectively. The opening 118 is smooth walled while opening 120 is threaded. Each pair of holes 118 and 120 is aligned with a threaded hole 116 in one end of the clamping bar 112. A screw 122 having a knurled cap extends through the aligned openings 116, 118 and 120. The strip is mounted on the wheel by wrapping it about the wheel's periphery, with the opposite ends 124 of the strip disposed in the channel 108 between the clamping bar 114 and the wall portion 110. Both screws 124 are then tightened to clamp the ends 124 of the abrasive strip in place, thereby holding the strip tightly on the periphery of the cylindrical wheel 92.

Figure 5:
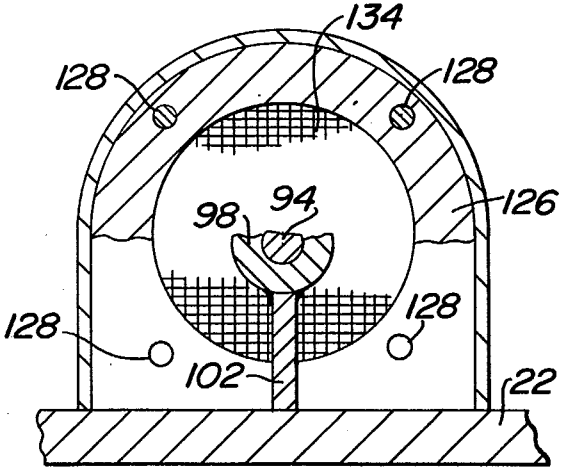
FIG. 5 is a sectional view taken along line 5—5 of FIG. 1.

As can be seen in FIGS. 3 and 5 the fan-filter assembly 36 includes a filter-holding frame 126 mounted within the housing 24 adjacent its end 82. The filter frame 126 includes a plurality of threaded openings 128 for receipt of screws 84. The fan-filter assembly includes a cover 130 having a flanged skirt 132 including holes through which the screws 84 extend into engagement with the threaded openings 128 in the filter frame to hold the cover 130 in place and close the end of the housing 24. A filter element 134 is interposed between the frame 126 and the flanged skirt 132 of the filter assembly cover 130. Referring to FIG. 1 it can be seen that the cover 130 includes plural vents 136 disposed over the filter element 134. A small, electrically operated fan having an impeller 138 is mounted within the fan-filter assembly cover 130, with the impeller located immediately adjacent to the filter element 134 and arranged to pull air from inside the housing 24 through the filter. The vents 136 serve as the outlets for air drawn by the operation of the fan.

As noted heretofore, the carrier tray 56 is arranged to be moved into the housing, via entrance passageway 88, so as to bring the top surface of the microfiche card under the abrasive surface of the wheel 92 so that the wheel bites into and scrapes the diazo dye image from the surface of the card as the card is moved under the wheel. The flanged stop 75 is arranged to contact the front surface of the front wheel 76 contiguous with the entrance passageway 88 when the tray is fully extended into the housing. This action prevents the card from being extended beyond the wheel, which action could impede withdrawal of the tray from the housing when removing the card.

Operation of the apparatus 20 is as follows: the depth of bite of the rotary scaling wheel is adjusted by setting the four adjustment knobs 50 to the desired position, to thereby raise or lower the bed and the carrier tray supported thereby with respect to the abrasive wheel. Once the bed height has been adjusted, the handle 74 of the carrier tray is pulled outward (to the right in FIG. 1) to totally withdraw the tray from the housing. The hold-down frame 66 is then pivoted upward, and the microfiche card to be obliterated is disposed on the top surface of the tray. The hold-down frame is then pivoted downward so that its side legs 68 cover the lateral edges of the card to hold the card in place. The tray is then moved into the housing by pushing inward on the handle, whereupon the forward edge of the card 30 enters through passageway 88 and under the abrasive wheel 92. The wheel rotates in the direction of the arrow 138 in FIG. 2 at a higher peripheral speed than the speed at which the tray is moved into the housing. Continued inward displacement of the tray 56 carries the microfiche card 30 with its diazo dye image 32 thereon under the rapidly rotating wheel. Since the wheel is rotating at a higher peripheral speed than the speed at which the tray is fed into the housing, the abrasive surface 106 of the wheel bits into or otherwise scrapes the dye off of the top surface of the card's film base. Continued inward displacement of the tray until stop 75 makes contact with the housing carries the microfiche card completely past the rotating wheel, so that the entire length of the card is obliterated.

During the scraping operation the abrasive surface on the wheel breaks up the diazo dye or other emulsion forming the image into a multitude of fine particles or dust. Such particles are precluded from gaining excess to the ambient atmosphere by the operation of the fan. To that end as will be appreciated by those skilled in the art, as the fan operates it tends to pull in ambient air through passageways 88 and 90 in the housing, thereby creating a slightly lower air pressure within the housing than outside it. This action precludes the particles from gaining egress through the passageways 88 and 90. In addition, the fan causes a stream of particle-laden air to flow from the housing into the fan-filter assembly. The particles are trapped in the filter element 134 while the filtered air exits the cover 130, via the vents 136.

After the tray has been fully extended into the housing the handle 74 is pulled rearwardly to withdraw the tray from the housing. Once the tray is fully retracted the hold-down frame 66 is pivoted up and the card removed. The apparatus is now ready for operation on another card.

As should be appreciated from the foregoing, the instant invention is simple in construction, yet it offers a viable approach for mechanically removing images from the surface of microfiche cards or other microfilm formats. It must be pointed out at this juncture that the instant invention is not limited to use with short sections of microfilm but can be used to scrape continuous roll microfilm as well. In addition, automatic feeding means may be utilized in lieu of the manually operated carrier tray shown in the drawings herein.

Without further elaboration, the foregoing will so fully illustrate my invention that others may, by applying current of future knowledge, readily adapt the same for use under various conditions of service.

I claim:

1. Apparatus for removing an image disposed on a surface of a section of film comprising a housing, carrier means and scaling means, said scaling means comprising a rotatable wheel about which a strip of abrasive material is releasably secured by clamping means, said carrier means comprising a tray arranged for reciprocation into said housing and under said wheel, with the distance said tray is disposed below said wheel being adjustable, said tray including a clamping means in the form of a hingedly secured generally U-shaped frame comprising a pair of side legs and a cross-piece defining an opening, said frame arranged for disposition over edge portions of said film section to secure said film section on said tray with its image carrying surface exposed in the opening, said carrier means being moved relative to said scaling means to carry said film section into contact with said scaling means, whereupon said scaling means scraps along the exposed surface of said film section to remove the image therefrom.

2. The apparatus of claim 1 wherein said scaling means is disposed within said housing, said housing being arranged to trap particles produced as the image is scraped from said film section.

3. The apparatus of claim 2 wherein said housing is mounted on a base, said base including a bed whose height with respect to said base is adjustable, said bed including an opposed pair of rails, said a tray being disposed on said bed between said rails and slideable therealong into said housing and into contact with said scaling means.

4. The apparatus of claim 3 wherein said housing includes an entrance through which said tray passes, said housing including fan means for drawing air through said entrance into said housing for passage through a filter located therein, whereupon particles produced during the scraping operation are trapped in said filter.

5. The apparaus of claim 4 wherein said wheel is driven by electric motor means.

6. The method of mechanically removing an image disposed on the surface of a section of film having a peripheral edge comprising the steps of disposing said section of film on a carrier, clamping the peripheral edges of said section of film to said carrier while exposing the remaining portion thereof, rotating an abrasive wheel, moving said carrier to carry said film section in a path into contact and past said rotating wheel at a speed which is lower than the peripheral speed of said wheel, whereupon said wheel scrapes the exposed surface of said film section to remove the image therefrom.

7. The method of claim 6 additionally comprising the steps of trapping particles created during the scraping process in a filter.

8. The method of claim 7 wherein said film section is a microfiche card.

* * * * *